US006193819B1

(12) United States Patent
Kim et al.

(10) Patent No.: US 6,193,819 B1
(45) Date of Patent: Feb. 27, 2001

(54) METHOD FOR MANUFACTURING COLD ROLLED SHADOW MASK STEEL SHEET WITH STACKED ANNEALING

(75) Inventors: Gyosung Kim; Hyun-Gyu Hwang; Eel-Young Kim; Joung-Hoon Cheoi; Jong-Ho Kim; Young-Mo Kim; Ohjoon Kwon; Ki-Ho Kim, all of Pohang-si (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/465,036

(22) Filed: Dec. 16, 1999

(30) Foreign Application Priority Data

Dec. 18, 1998 (KR) ..... 98-56291

(51) Int. Cl.[7] ..... C21D 8/02
(52) U.S. Cl. ..... 148/629; 148/651
(58) Field of Search ..... 148/651, 629

(56) References Cited

U.S. PATENT DOCUMENTS 4,210,843 7/1980 Avadani ..... 313/403
4,235,752 11/1980 Rossall et al. ..... 252/551
4,609,412 9/1986 Kamio et al. ..... 148/12 C

FOREIGN PATENT DOCUMENTS

363062821 * 3/1988 (JP) .

* cited by examiner

*Primary Examiner*—Deborah Yee
(74) *Attorney, Agent, or Firm*—Webb Ziesenheim Logsdon Orkin & Hanson, P.C.

(57) ABSTRACT

A method for manufacturing a cold rolled steel sheet for use in a shadow mask is disclosed, in which without adding an expensive alloy element, a short intermediate decarburization annealing is carried out, and despite this fact, a forming defect does not occur after the forthcoming stacked annealing. The method includes the steps of preparing a steel composed of, in weight %, 0.003% or less of C, 0.10–0.20% of Mn, 0.01–0.05% of Al, 0.004% or less of N, and a balance of Fe and other unavoidable impurities. A hot rolling is carried out on the steel at a temperature of above 910° C., and then, a first cold rolling is carried out to form a first cold rolled steel sheet. Then a decarburization is carried out on the first cold rolled steel sheet down to a carbon content of 0.0015% to form a decarburized steel sheet, and then a second cold rolling with a reduction ratio of more than 35% is carried out on the decarburized steel sheet.

2 Claims, 7 Drawing Sheets

METHOD FOR MANUFACTURING COLD ROLLED SHADOW MASK STEEL SHEET WITH STACKED ANNEALING

FIELD OF THE INVENTION

The present invention relates to a method for manufacturing a cold rolled steel sheet for use in the shadow mask of a braun tube. More specifically, the present invention relates to a method for manufacturing a cold rolled steel sheet for use in the shadow mask of a braun tube, in which a decarburization is carried out down to a carbon content of 0.0015% between two steps of cold rolling to manufacture a cold rolled steel sheet, and thus, a yield point elongation is lowered more than 4% in the forthcoming stacked annealing regardless of the stacked position.

BACKGROUND OF THE INVENTION

Generally, the shadow mask of the braun tube (illustrated in FIG. 1) has the color selection function. This shadow mask is manufactured in the following manner. That is, as shown in FIG. 2, a plurality of tiny holes are formed in a cold rolled steel sheet by applying a photo etching method. Then a final decarburization is carried out, and then, a press-forming is carried out.

For the shadow mask, a high purity steel is required, and at the same time, it is important that the carbon content is controlled to a certain level. The reason is that when the press-forming is carried out by the cathode ray tube manufacturing company, the carbon content is closely related to the generation of defects. That is, if the yield strength increases due to the increase of the carbon content, then the shape fixability is aggravated. Further, due to the generation of a stretcher strain caused by the solute carbon, a non-uniform deformation is formed, with the result that the sizes of the holes (formed by applying the photo etching process) are varied.

Techniques for solving the above described problems are disclosed in U.S. Pat. Nos. 4,210,843, 4,609,412 and 4,235,752.

First, in U.S. Pat. No. 4,210,843, there is used an IF (interstitial-free) steel in which the carbon content is extremely low, that is, as low as 0.01 wt % (to be called simply "%" below), and Nb is singly added, or Nb and Ti are combinedly added. In this manner, the yield point elongation is eliminated. In this method, however, the expensive alloy element has to be added. Further, the recrystallization temperature rises due to the added element, and the magnetic properties are aggravated due to the inhibition of the grain growth, which is caused by the precipitates.

Meanwhile, in U.S. Pat. No. 4,609,412, the carbon content is regulated to below 0.004% to improve the demagnetization characteristics of the shadow mask. To achieve this, the carbon content is controlled to below 0.008% at the steel manufacturing stage, and the carbon content is lowered down to 0.005% at an intermediate decarburization annealing. In this method, however, an OCA (open coil annealing) is adopted at the intermediate decarburization annealing, and therefore, the treating time is as long as several days. Further, the carbon content is regulated to 0.004% or 0.005% at the cold rolled state, and in the case where the cathode ray tube manufacturing company carries the annealing by stacking the steel sheets, the yield point elongation occurs at the intermediate portion of the stacking (FIG. 4). Therefore, the relevant sheets have to pass the roller leveller, if the forming defects are to be prevented.

Meanwhile, in U.S. Pat. No. 4,235,752, a method is proposed in which the initial carbon content is regulated to 0.01%, and the final decarburization annealing by the cathode ray tube manufacturing company is carried out at a temperature of 650–850° C. In this method, however, the lowering of the carbon content is heavily dependent on the cathode ray tube manufacturing company, and therefore, as in the above described case, the steel sheets stacked in the middle level are liable to show the forming defects. Therefore, the disadvantage exists that the roller levelling has to be carried out before the press-forming.

SUMMARY OF THE INVENTION

The present invention is intended to overcome the above described disadvantages of the conventional techniques.

Therefore it is an object of the present invention to provide a method for manufacturing a cold rolled steel sheet for use in a shadow mask, in which without adding an expensive alloying element, a short intermediate decarburization annealing is carried out, and despite this fact, a forming defect does not occur after the forthcoming stacked annealing.

In achieving the above object, the method for manufacturing a cold rolled steel sheet for use in a shadow mask according to the present invention includes the steps of: preparing a steel composed of, in weight %, 0.003% or less of C, 0.10–0.20% of Mn, 0.01–0.05% of Al, 0.004% or less of N, and a balance of Fe and other unavoidable impurities; carrying out a hot rolling on the steel at a temperature of above 910° C., and then, carrying out a first cold rolling to form a first cold rolled steel sheet; carrying out a decarburization on the first cold rolled steel sheet down to a carbon content of 0.0015% to form a decarburized steel sheet; and carrying out a second cold rolling with a reduction ratio of higher than 35% on the decarburized steel sheet.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE INVENTION

Figure 1:
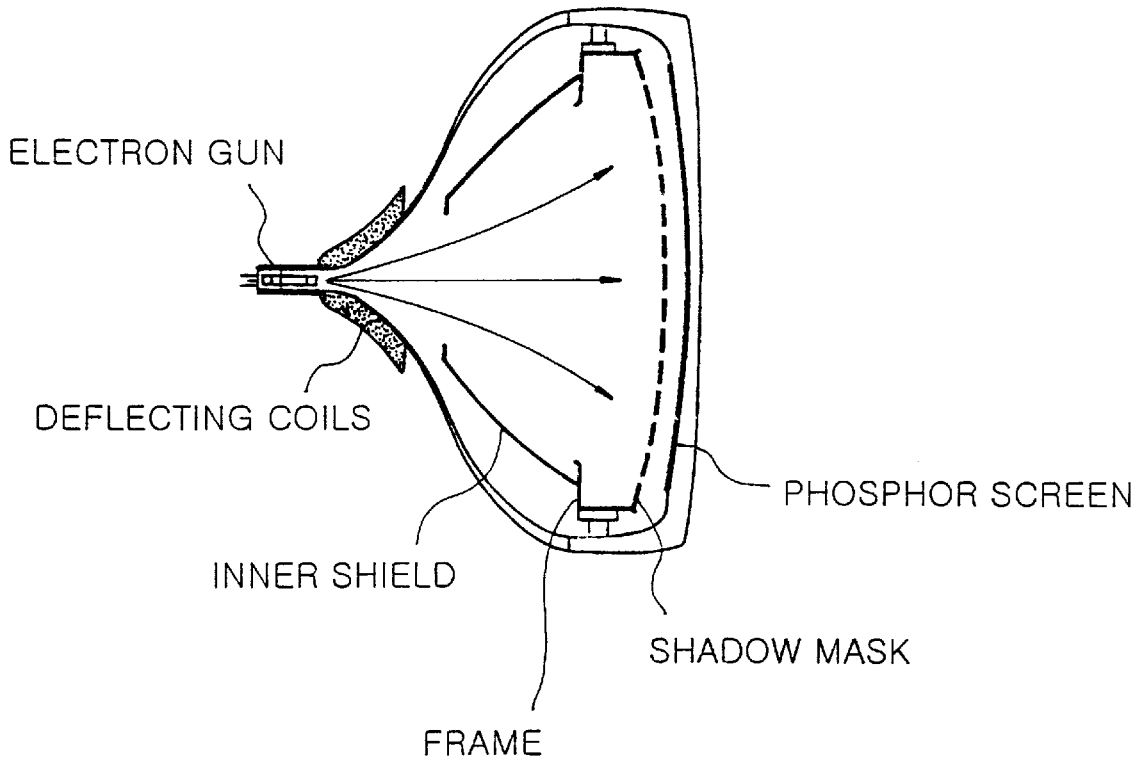
FIG. 1 illustrates the structure of the braun tube.

If the decarburization annealing is carried out by the cathode ray tube manufacturing company on the cold rolled steel sheet for the shadow mask, then the steel sheets positioned at the intermediate level will show a forming defect due to the yield point elongation, and therefore, the roller levelling has to be necessarily carried out.

The present invention solves the above described disadvantages. Therefore, the method for manufacturing a cold rolled steel sheet for use in a shadow mask according to the present invention includes the steps of: preparing a steel composed of, in weight %, 0.003% or less of C, 0.10–0.20% of Mn, 0.01–0.05% of Al, 0.004% or less of N, and a balance of Fe and other unavoidable impurities; carrying out a hot rolling on the steel at a temperature of above 910° C., and then, carrying out a first cold rolling to form a first cold rolled steel sheet; carrying out a decarburization on the first cold rolled steel sheet down to a carbon content of 0.0015% to form a decarburized steel sheet at a temperature of 800–860° C. for 1–5 minutes; and carrying out a second cold rolling with a reduction ratio of higher than 35% on the decarburized steel sheet.

That is, the first cold rolled steel sheet for use in the shadow mask is decarburized at a continuous annealing decarburization facility, and thus, the carbon content of the steel sheet is controlled to 0.0015% or less. Specifically, the carbon content is properly controlled at the initial steel slab state. Then at the decarburization annealing between the two steps of cold rolling, the carbon content is controlled to 0.0015% or less. Thus without adding the expensive alloy elements, the yield point elongation is maintained at 4% or less by carrying out a short decarburization annealing. In other words, if the yield point elongation is maintained at 4% or less, then even if the cathode ray tube manufacturing company carries out the stacked annealing, the conventional forming defects can be avoided.

In the present invention as described above, the carbon content at which the yield point elongation does not occur is defined to be 0.0015% or less. This carbon content is meant to be the total carbon content. Generally, the carbon present in a steel is divided into two kinds, i.e., the solute carbon and the carbon precipitated in the form of carbides. Of these two kinds, the carbon precipitating as carbides does not give any influence to the yield point elongation, while the solute carbon gives direct effects to the yield point elongation. As the content of the solute carbon increases, the yield point elongation increases.

Generally it is known that if the yield point elongation is to be completely removed, the solute carbon content should be 0.0003% or less. In this context, the present inventor found the following fact. That is, the total carbon content could be controlled to 0.0015% within a short period of time by decarburizing the first cold rolled steel sheet at proper annealing conditions, and thus, by lowering the solute carbon content, a yield point elongation of 4% or less could be attained.

Now the individual ingredients of the steel slab of the present invention will be described.

Carbon (C) is the most important element, and its content is maintained at 0.003%. The reason why this initial C ingredient is limited in this manner is as follows. That is, the target C content 0.0015% is barely obtained by the current steel manufacturing techniques. And with the current steel manufacturing techniques, a carbon content of 0.002–0.003% cannot be easily achieved without a drastic increase in the manufacturing cost and ensure the target C content of 0.0015% after short-intermediate decarburization annealing. Of course, if a steel with a C content of 0.0015% is manufactured from the steel slab manufacturing stage, then the steel sheet for the shadow mask could be manufactured even without carrying out the intermediate decarburization annealing. However, in this latter case, the steel slab manufacturing stage requires too high a manufacturing cost.

Manganese (Mn) is added to prevent the red shortness caused by sulphur which is unavoidably contained in the steel. If the Mn content is too low, the red shortness remains all the same. On the other hand, if its content is too high, then the strength of the steel is increased, with the result that the shape fixability is aggravated. Therefore, the Mn content in the present invention is limited to 0.10–0.20%.

Aluminum (Al) is added for two purposes. One of the purposes is to remove oxygen present in the steel so as to prevent the formation of non-metallic inclusions during the solidification. Another is to fix nitrogen of the steel in the form of AlN, so that the yield point elongation due to the solute nitrogen can be inhibited. Accordingly, Al also has to be added in a proper amount. That is, if its content is too low, then the above described additional purpose cannot be realized. On the other hand, if its content is too high, then the strength of the steel is increased, and the blackening treatment is aggravated. Therefore, the Al content is limited to 0.01–0.05%.

All of N are secured in the form of AlN as described above. In fact, however, if the N content is too high, then the Al content also will be high. Therefore, the N content is limited to 0.004% or less by using a vacuum degassing facility.

Now the method for manufacturing the cold rolled steel sheet for use in the shadow mask will be described.

The steel with the above described composition is formed into a steel slab by applying a continuous casting process or an ingot casting process. Then the slab is hot-rolled into a hot rolled steel sheet. Under this condition, the hot rolling needs to be finished at a temperature of higher than 910° C., and the reason for this is as follows. That is, if the hot rolling temperature is lower than the $Ar_3$ transformation temperature, then ferrite is formed due to the phase transformation, with the result that it is difficult to control the shape and thickness during the rolling.

After the hot rolling, the hot rolled steel sheet is coiled, and the coiling temperature is not specially limited. In the conventional techniques, there are cases where the coiling temperature is limited, and this is for making Al and N bonded together. In the present invention, however, the intermediate decarburization annealing is as high as 800–860° C., and therefore, the AlN reaction briskly occurs simultaneously with the decarburization reaction. Therefore, even if the coiling temperature is not specially limited, all the N can be secured into the precipitates.

Then the coiled hot rolled steel sheet is pickled, then a first cold rolling is carried out, and then, an intermediate decarburization annealing is carried out at a continuous decarburization heat treatment facility. The reason why the first cold rolling is carried out prior to the intermediate decarburization annealing is as follows. That is, first a proper second cold rolling reduction rate has to be secured before carrying out the cold rolling to the final thickness. Second, if the carbon present in the steel is to be removed by the decarburization annealing within a short period of time, then the thickness of the steel sheet has be made thin to a proper degree.

In the present invention, the decarburization annealing has to be carried out preferably at a temperature of 800–860° C., and the reason is as follows. That is, if the temperature is below 800° C., then the decarburizing reaction rate is too slow, and therefore, a C content of 0.0015% or less cannot be attained within a short period of time. On the other hand, if the temperature exceeds 860° C., then not only the tension control at the continuous heat treatment facility becomes difficulty but also an inverse transformation to austenite with a high C solubility occurs to slow down the decarburization rate so as to make it undesirable.

Further, in the present invention, the decarburization annealing has to be carried out for 1–5 minutes, and the reason is as follows. That is, if the decarburization annealing time is less than 1 minute, the decarburization reaction is not sufficient. On the other hand, if it exceeds 5 minutes, although there is no problem in terms of the decarburization reaction, the effect of the time extension is diminished after 5 minutes, thereby aggravating the economy of the process.

After the decarburization annealing, a second cold rolling is carried out. Under this condition, the cold rolling reduction ratio should be proper. Preferably, the reduction ratio should be 35% or more, and the reason Is as follows. That is, when a perforation is carried out through an etching, a certain level of strength is required. According to the present inventor's investigation, the tensile strength of the stock has to be 540 MPa or more for carrying out the perforation, and in order to satisfy this condition, the reduction ratio has to be 35% or more. That is, only when the stock has a tensile strength of 540 Ma or more, can the stock withstand against the tension stress of photo etching line, and be immune to scratching or the like. However, if the reduction ratio is too high, the grain size becomes too fine after the final annealing, with the result that the magnetic properties are aggravated. Therefore, the reduction ratio should be preferably 35–70%.

Now the present invention will be described based on actual examples.

EXAMPLE 1

Figure 2:
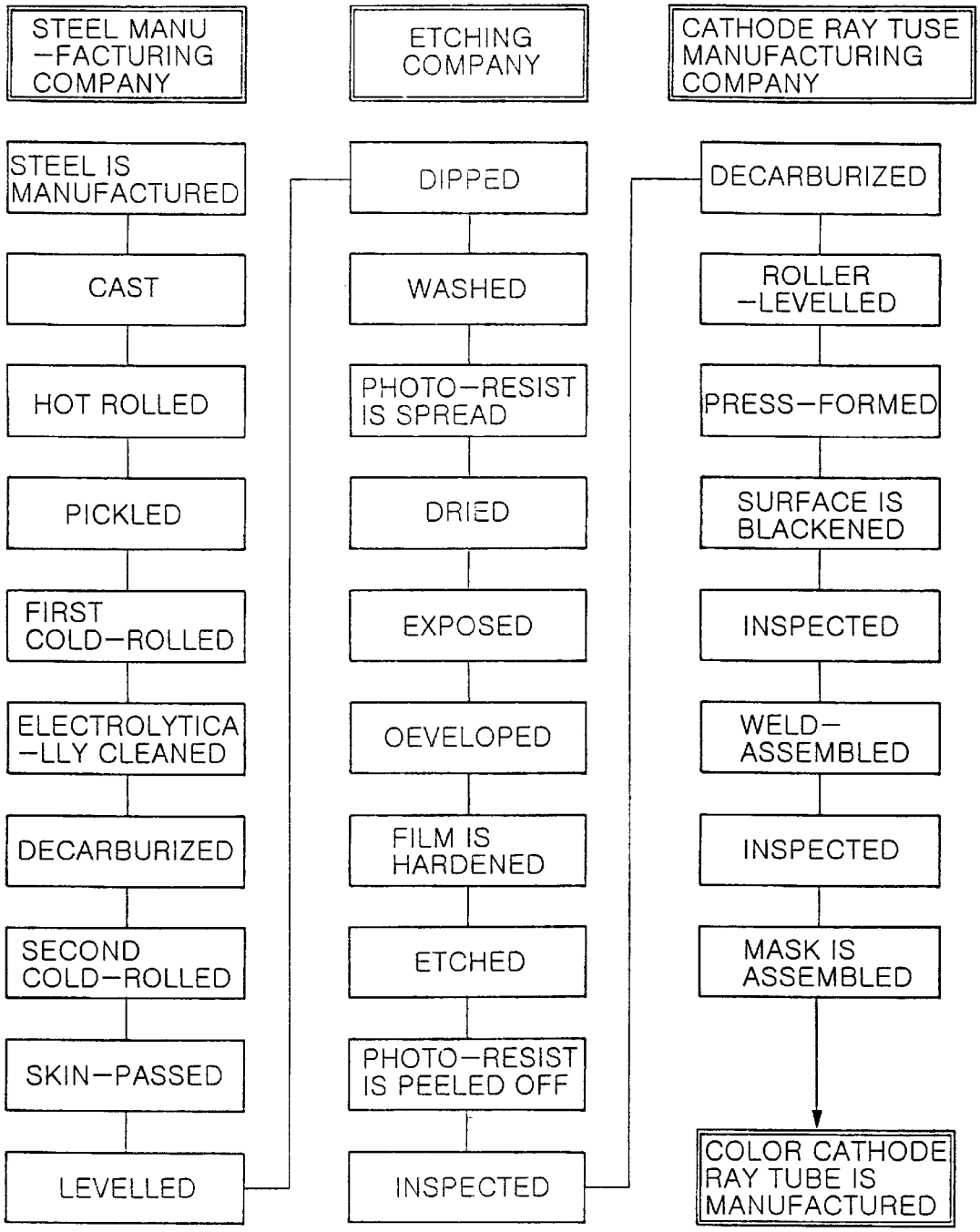
FIG. 2 illustrates the manufacturing process and the post process for the cold roiled steel sheet for use in the shadow mask.
Figure 3:
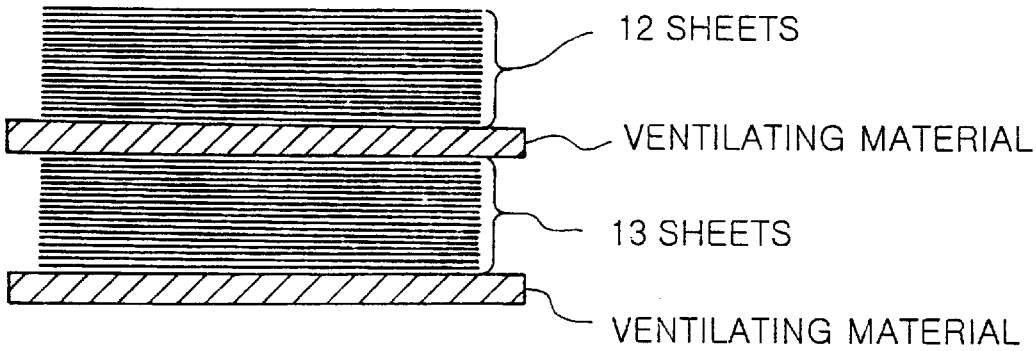
FIG. 3 illustrates an example of the stacked annealing for the cold rolled steel sheet for use in the shadow mask.
Figure 4:
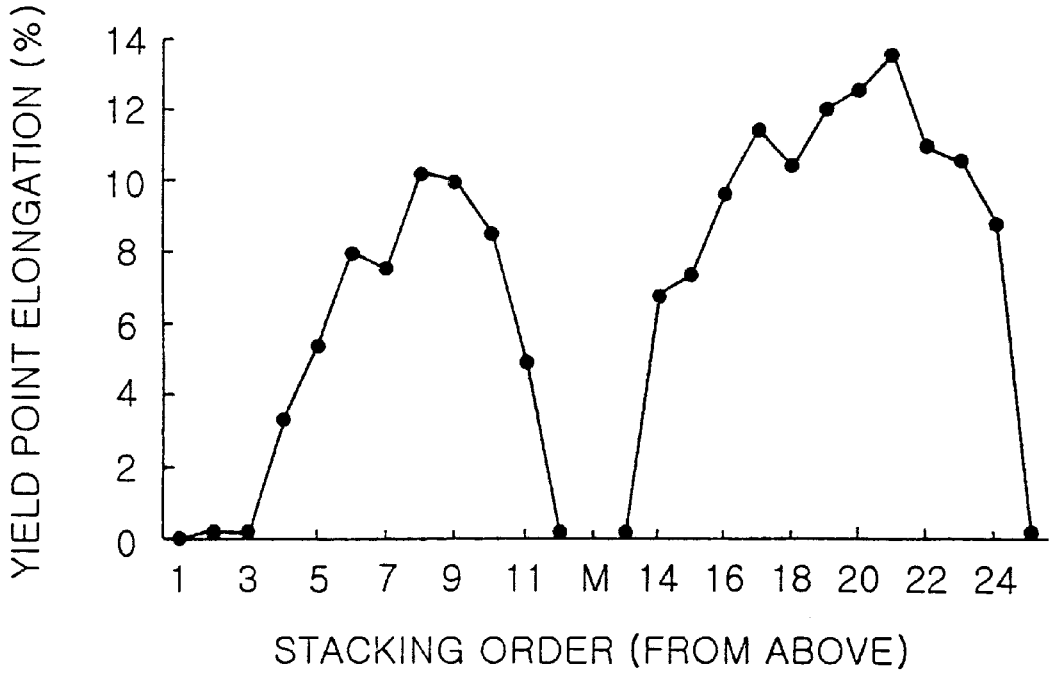
FIG. 4 is a graphical illustration showing the yield point elongation with respect to the stacked position in the stacked annealing (conventional stock)

As shown in FIG. 2, cold rolled steel sheets (conventional material) having the composition of Table 1 and having a plurality of holes (formed by a photo etching as is done by cathode ray tube manufacturing companies) were stacked based on the method of FIG. 3, and were made to undergo a decarburization annealing. Then, the yield point elongations for different stacking positions were checked, and the results are shown in FIG. 4. Meanwhile, the ventilating material of FIG. 3 was installed to make the flow of the decarburizing atmospheric gas smooth.

TABLE 1

| Chemical composition (wt %) | | | | | | |
|---|---|---|---|---|---|---|
| C | Si | Mn | P | S | Al | Fe |
| 0.0024 | 0.004 | 0.15 | 0.012 | 0.006 | 0.041 | Balance |

As could be seen in FIG. 4, when the cold rolled steel sheet with a C content of 0.0024% was made to undergo a stacked annealing, a yield point elongation did not occur in the upper, lower and ventilating-material-adjacent steel sheets because they were profusely contacted to the decarburizing atmospheric gas. However, in the rest of the steel sheets, the yield point elongation occurred up to 14%. Thus, at the yield point elongation of more than 4%, there occurred forming defects due to non-uniform deformations. In order to prevent this phenomenon, a roller levelling must be carried out.

EXAMPLE 2

A steel with the composition of Table 1 was cold-rolled as a first cold rolling down to a thickness of 0.5 mm. Then it was heat-treated under a decarburizing atmosphere, while varying the annealing time and the annealing temperature. Then the yield point elongation was checked for the mentioned conditions based on the tensile test method, and the results are shown in FIG. 5.

Figure 5:
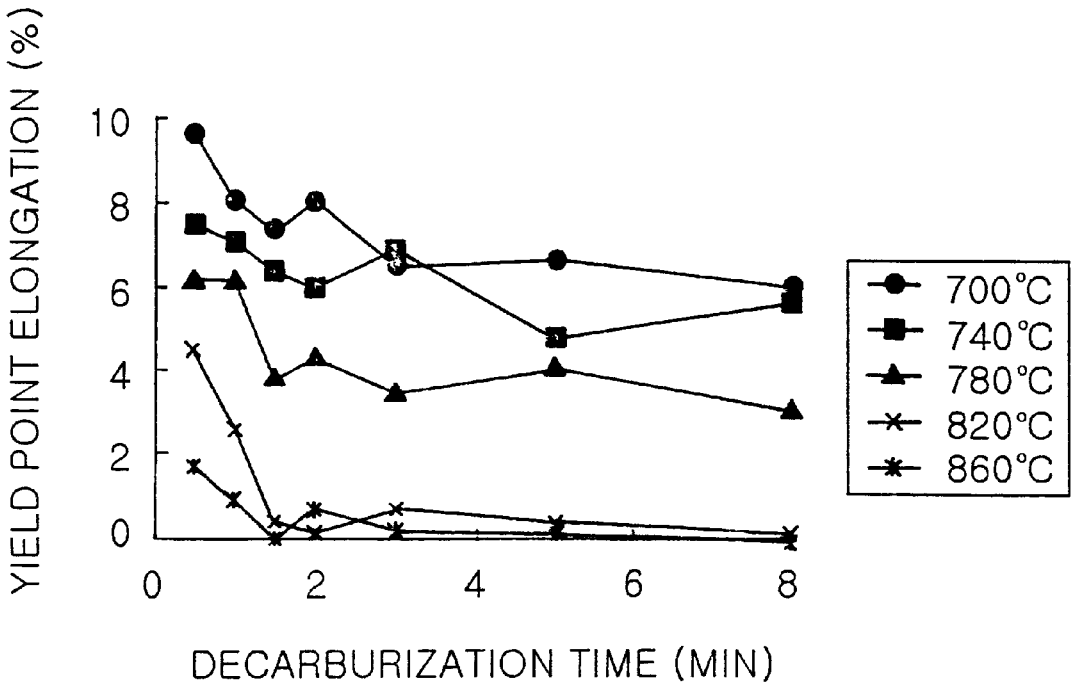
FIG. 5 is a graphical illustration showing the yield point elongation with respect to the conditions of the decarburization annealing.

As could be seen in FIG. 5, a yield point elongation of 4% or less could be attained by decarburizing at temperatures of 800° C. and 860° C. for 1 minute or more. In contrast to this, when the annealing was carried out at 780° C., a yield point elongation of 4% or less could not be attained within an annealing time of 1–5 minutes. When the annealing was carried out at 740° C. and at 700° C., the yield point elongation was very high regardless of the annealing time.

In FIG. 5, when the total carbon content was measured for the test pieces of the present invention, they all showed total carbon contents of 0.0007–0.0015%. When the solute carbon content was measured by applying the internal friction method, the solute carbon was not detected at all. On the other hand, when the total carbon contents were measured for test pieces which were annealed at 700° C., 740° C. and 780° C., they showed respectively 0.0020–0.0024%, 0.0016–0.0018% and 0.0013–0.0017%.

Thus by controlling the decarburization annealing so as to make the total carbon content 0.0015% or less, a yield point elongation of 4% or less could be attained.

EXAMPLE 3

In order to check the C content effect at the initial stage in the steel slab, a steel with the composition of Table 2 was prepared, and then, a cold rolling was carried out down to a thickness of 0.5 mm. Then a decarburization annealing was carried out at 840° C. for 2 minutes. Then the yield point elongation was measured, and the measured results also are shown in Table 2 below.

TABLE 2

| Chemical composition (wt %) | | | | YP elongtn | |
|---|---|---|---|---|---|
| C | Mn | Si | Al | after decrb | Remarks |
| 0.0026 | 0.15 | 0.003 | 0.04 | 0.3 | Inventive steel |
| 0.0035 | 0.12 | 0.002 | 0.04 | 4.8 | Comparative steel |
| 0.0074 | 0.16 | 0.002 | 0.03 | 8.6 | Comparative steel |
| 0.120 | 0.18 | 0.004 | 0.02 | 7.5 | Comparative steel |

As can be seen in Table 2 above, in the case of the inventive steel with an initial carbon content of 0.0026%, the yield point elongation was 0.3, thereby sufficiently obtaining the target level. In contrast to this, in the cases of the comparative steels with initial carbon contents of more than 0.0033%, the yield point elongation of 4% was exceeded even if the annealing was carried out for a given period of time. Of course, even if the initial carbon content was as high as the comparative steels, if the decarburization annealing was carried out for a long period of time, then the final carbon content was as low as 0.0015% or less. In this case, however, a long annealing time is required, therefore decreasing the economy of the process.

EXAMPLE 4

In order to decide the range of the reduction ratio of the second cold rolling after the decarburization, a first cold rolling was carried out on the inventive steel of Table 2. Then the first cold rolled steel sheets were subjected to a decarburization annealing at a temperature of 830° C. for 1.5 minutes. Then a second cold rolling was carried out on each of the annealed steel sheets while varying the reduction ratio. Then tensile strength was measured for the second cold rolled steel sheets, and the results are shown in FIG. 6.

Figure 6:
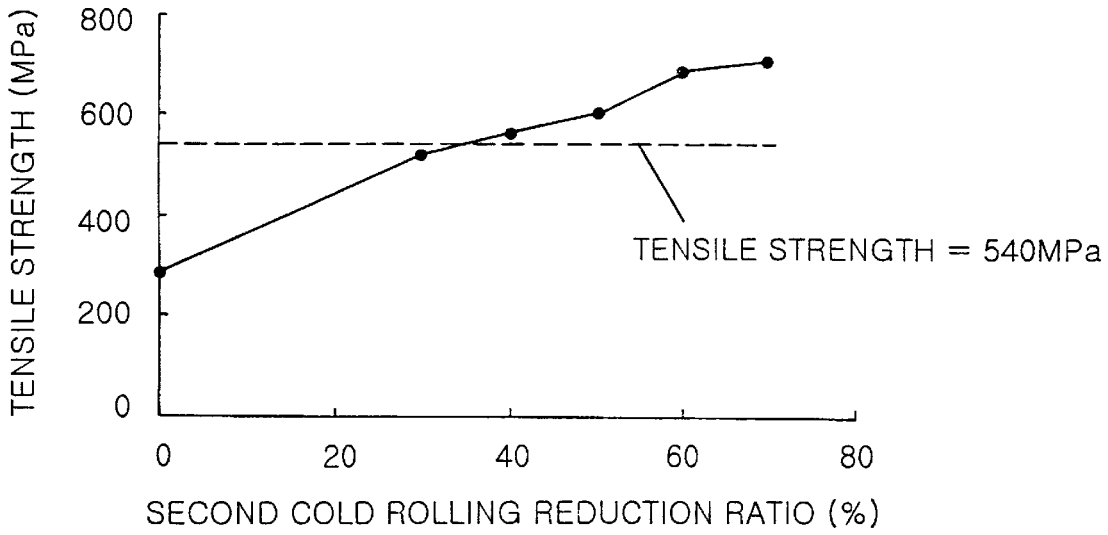
FIG. 6 is a graphical illustration showing the tensile strength with respect to the reduction ratio of the cold rolling.

As could be seen in FIG. 6, a tensile strength of 540 MPa could be attained near the reduction ratio of 35%, and as the reduction ratio was increased, the tensile strength was increased. However, as the second cold rolling reduction ratio was increased, the grain size was decreased, this being a problem. Further, considering the capability of the second cold rolling mill, the range of the reduction ratio should be preferably 35–70%.

EXAMPLE 5

The inventive steel of Table 2 was cold-rolled, and then, a decarburization was carried out on the same steel sheets at 830° C. for 1.5 minutes. Then the decarburized steel sheets were second-cold-rolled with a reduction ratio of 57%. Then they were stacked in the manner of FIG. 3, and then, an annealing was carried out on them. Then the yield point elongation was measured, and the results are shown in FIG. 7.

Figure 7:
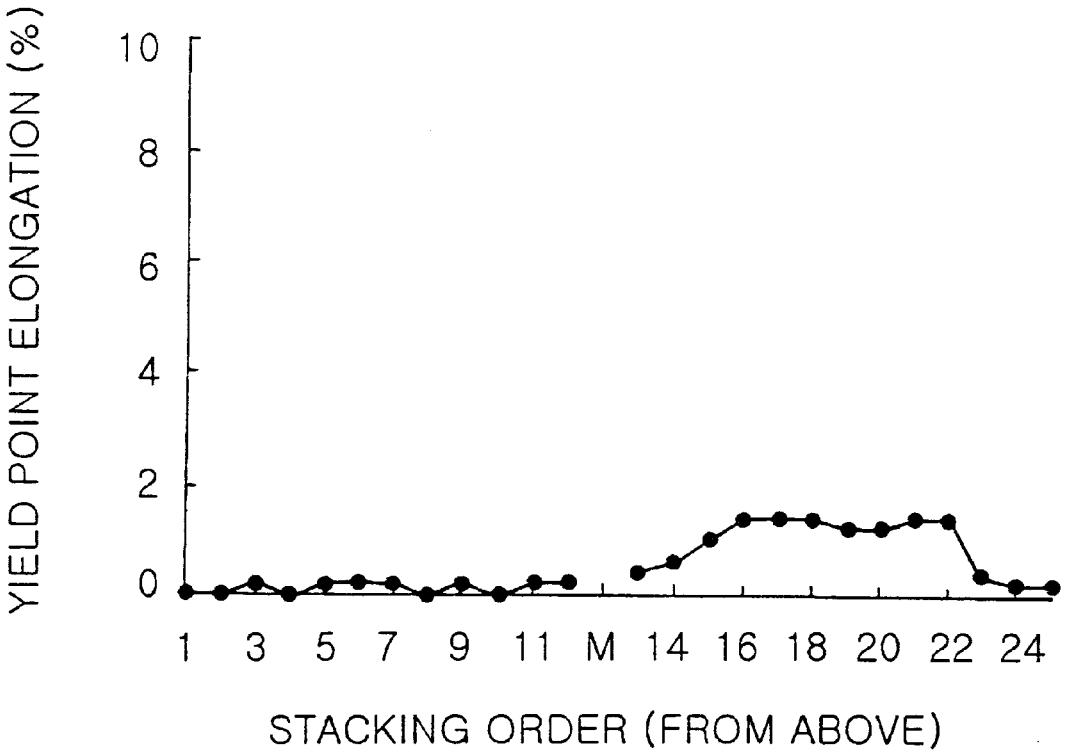
FIG. 7 is a graphical illustration showing the yield point elongation with respect to the stacked position in the stacked annealing (the inventive stock).

As shown in FIG. 7, the yield point elongation was 2% or less regardless of the stacking positions, thereby excluding any occurrence of the forming defects.

According to the present invention as described above, the first cold rolled shadow mask steel is decarburized at proper conditions to control the carbon content to 0.0015% or less. Therefore, when a cathode ray tube manufacturing company carries out a stacked annealing, a roller levelling is not required so as to improve the economy of the process. Further, during the manufacturing process, the decarburization annealing is very short, and despite this fact, the target product quality can be attained, so that the productivity can be improved.

What is claimed is:

1. A method for manufacturing a cold rolled shadow mask steel sheet, comprising the steps of:

preparing a steel composed of, in weight %, 0.003% or less of C, 0. 10–0.20% of Mn, 0.01–0.05% of Al, 0.004% or less of N, and a balance of Fe and other unavoidable impurities;

hot rolling the steel at a temperature of above 910° C., and then cold rolling the steel to form a cold rolled steel sheet;

decarburization annealing said cold rolled steel sheet down to a carbon content of 0.001 5% or less to form a decarburized steel sheet at a temperature of 800–860° C. for 1–5 minutes; and cold rolling said decarburized steel sheet with a reduction ratio of more than 35% to provide a finished cold rolled steel sheet having a minimum tensile strength of 540 MPa.

2. The method as claimed in claim 1, wherein the second cold rolling is carried out with a reduction rate of 35–70%.

* * * * *

UNITED STATES PATENT AND TRADEMARK OFFICE

CERTIFICATE OF CORRECTION

PATENT NO. : 6,193,819 B1
DATED : February 27, 2001
INVENTOR(S) : Gyosung Kim et al.

It is certified that error appears in the above-identified patent and that said Letters Patent is hereby corrected as shown below:

Column 5,
Line 4, "difficulty" should read -- difficult --.
Line 13, "aggravating" should read -- decreasing --.
Line 17, "the reason Is" should read -- the reson is --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*